US006739705B2

(12) United States Patent
Jeanmaire et al.

(10) Patent No.: US 6,739,705 B2
(45) Date of Patent: May 25, 2004

(54) CONTINUOUS STREAM INK JET PRINTHEAD OF THE GAS STREAM DROP DEFLECTION TYPE HAVING AMBIENT PRESSURE COMPENSATION MECHANISM AND METHOD OF OPERATION THEREOF

(75) Inventors: David L. Jeanmaire, Brockport, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 59 days.

(21) Appl. No.: 10/054,476

(22) Filed: Jan. 22, 2002

(65) Prior Publication Data

US 2003/0137566 A1 Jul. 24, 2003

(51) Int. Cl.[7] ..... B41J 2/09
(52) U.S. Cl. ..... 347/77
(58) Field of Search ..... 347/77, 2, 82, 347/40, 73–76, 78–80, 81, 84–85, 90; 400/118.2

(56) References Cited

U.S. PATENT DOCUMENTS

| | | | | |
|---|---|---|---|---|
| 1,941,001 A | | 12/1933 | Hansell | 178/96 |
| 3,373,437 A | | 3/1968 | Sweet et al. | 347/74 |
| 3,709,432 A | | 1/1973 | Robertson | 239/4 |
| 4,068,241 A | | 1/1978 | Yamada | |
| 4,190,844 A | * | 2/1980 | Taylor | 347/82 |
| 4,321,607 A | | 3/1982 | Heibein et al. | |
| 5,975,668 A | | 11/1999 | Fujii et al. | |
| 6,224,180 B1 | * | 5/2001 | Pham-Van-Diep et al. | 347/2 |
| 6,382,850 B1 | * | 5/2002 | Freund et al. | 400/118.2 |
| 6,457,807 B1 | * | 10/2002 | Hawkins et al. | 347/40 |
| 6,505,921 B2 | * | 1/2003 | Chwalek et al. | 347/77 |

FOREIGN PATENT DOCUMENTS

| | | |
|---|---|---|
| EP | 0911167 | 4/1999 |
| EP | 1219428 | 3/2002 |
| JP | 63209845 | 8/1988 |

* cited by examiner

*Primary Examiner*—Lamson Nguyen
*Assistant Examiner*—R. Feggins
(74) *Attorney, Agent, or Firm*—William R. Zimmerli

(57) ABSTRACT

A continuous stream ink jet printhead includes an ink droplet forming mechanism operable to selectively create a stream of ink droplets having a plurality of volumes and a droplet deflector having a gas source. The gas source is operable to interact with the stream of ink droplets thereby separating ink droplets having one of the plurality of volumes from ink droplets having another of the plurality of volumes. A sensor senses ambient pressure transients and is coupled to a controller which adjusts the gas flow, through a pressure compensation mechanism, to compensate for pressure transients.

28 Claims, 6 Drawing Sheets

CONTINUOUS STREAM INK JET PRINTHEAD OF THE GAS STREAM DROP DEFLECTION TYPE HAVING AMBIENT PRESSURE COMPENSATION MECHANISM AND METHOD OF OPERATION THEREOF

CROSS REFERENCE TO RELATED APPLICATION

This application is related to application Ser. No. 09/750,946 filed on Dec. 28, 2000, the disclosure of which is incorporated herein by reference.

FIELD OF THE INVENTION

This invention relates generally to the field of printing devices, and in particular to improving the quality of print yielded from continuous stream ink jet printers in which a liquid ink stream is broken into droplets, some of which are selectively deflected by a gas stream.

BACKGROUND OF THE INVENTION

Traditionally, digitally controlled ink jet color printing is accomplished by one of two technologies. Both can utilize independent ink supplies for each of the colors of ink provided. Ink is fed through channels formed in the printhead and each channel includes a nozzle from which droplets of ink are selectively ejected and deposited upon a print medium, such as paper. Typically, each technology requires separate ink delivery systems for each ink color used in printing. Ordinarily, the three primary subtractive colors, i.e. cyan, yellow and magenta, are used because these colors can produce, in general, up to several million shades or color combinations.

The first technology, commonly referred to as "drop on demand" (DOD) ink jet printing, provides ink droplets for impact upon a recording surface using a pressurization actuator, such as a thermal actuator, piezoelectric actuator, or the like. Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle helping to keep the nozzle clean.

With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. Some naturally occurring materials possessing these characteristics are quartz and tourmaline. The most commonly produced piezoelectric ceramics are lead zirconate titanate, barium titanate, lead titanate, and lead metaniobate.

The second technology, commonly referred to as "continuous stream" or "continuous" inkjet printing, uses a pressurized ink source which produces a continuous stream of ink droplets. Conventional continuous inkjet printers utilize electrostatic charging devices that are placed close to the point where a filament of working fluid breaks into individual ink droplets. The ink droplets are electrically charged and then directed to an appropriate location by deflection electrodes having a large potential difference. When printing is desired, the ink droplets are deflected into an ink capturing mechanism and either recycled or discarded. When printing is desired, the ink droplets are not deflected and allowed to strike a print media. Alternatively, deflected ink droplets may be allowed to strike the print media, while non-deflected ink droplets are collected in the ink capturing mechanism. Typically, continuous inkjet printing devices are faster than droplet on demand devices and can produce high quality printed images and graphics.

U.S. Pat. No. 1,941,001, issued to Hansell, and U.S. Pat. No. 3,373,437 issued to Sweet et al., each disclose an array of continuous ink jet nozzles wherein ink droplets to be printed are selectively charged and deflected towards the recording medium. This technique is known as "binary deflection" continuous ink jet printing.

Continuous ink jet printers that utilize electrostatic charging devices and deflector plates require many components and large spatial volumes in which to operate. This results in continuous inkjet printheads and printers that are complicated, have high energy requirements, are difficult to manufacture, and are difficult to control.

U.S. Pat. No. 3,709,432, issued to Robertson, discloses a method and apparatus for stimulating a filament of ink to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a print media.

U.S. Pat. No. 4,190,844, issued to Taylor, on Feb. 26, 1980, discloses a continuous inkjet printer in which a printhead supplies a filament of working fluid that breaks into individual ink droplets. The ink droplets are then selectively deflected by a first pneumatic deflector, a second pneumatic deflector, or both. The first pneumatic deflector is an "on/off" or an "open/closed" type having a diaphram that either opens or closes a nozzle depending on one of two distinct electrical signals received from a central control unit. This determines whether the ink droplet is to be printed or non-printed. The second pneumatic deflector is a continuous type having a diaphram that varies the amount a nozzle is open depending on a varying electrical signal received the central control unit. This oscillates printed ink droplets so that characters may be printed one character at a time. If only the first pneumatic deflector is used, characters are created one line at a time.

The use of an air flow to deflect droplets in a continuous inkjet printhead reduces the complexity of the printhead. However, such printheads are sensitive to environmental conditions and thus can produce inconsistent print quality.

SUMMARY OF THE INVENTION

An object of the present invention is to improve the quality of print from of a continuous ink jet printhead. To achieve this and other objects, a first aspect of the invention is an apparatus for printing an image comprising an ink droplet forming mechanism configured to selectively create a stream of ink droplets having a plurality of volumes and traveling along a trajectory path. A droplet deflector is configured to generate a gas flow at an output thereof interacting with the stream of ink droplets thereby separating ink droplets having one of a plurality of volumes from ink droplets having another of a plurality of volumes. A pressure sensor is positioned proximate the output and configured to generate a pressure indication signal. A controller is coupled to the pressure sensor and configured to output a compensation signal based on the indication signal, and a pressure mechanism is operatively coupled to the controller to adjust the gas flow generated by the droplet deflector.

BRIEF DESCRIPTION OF THE DRAWING

Other features and advantages of the present invention will become apparent from the following description of the preferred embodiment of the invention and the accompanying drawings, in which.

DETAILED DESCRIPTION OF THE INVENTION

Figure 1:
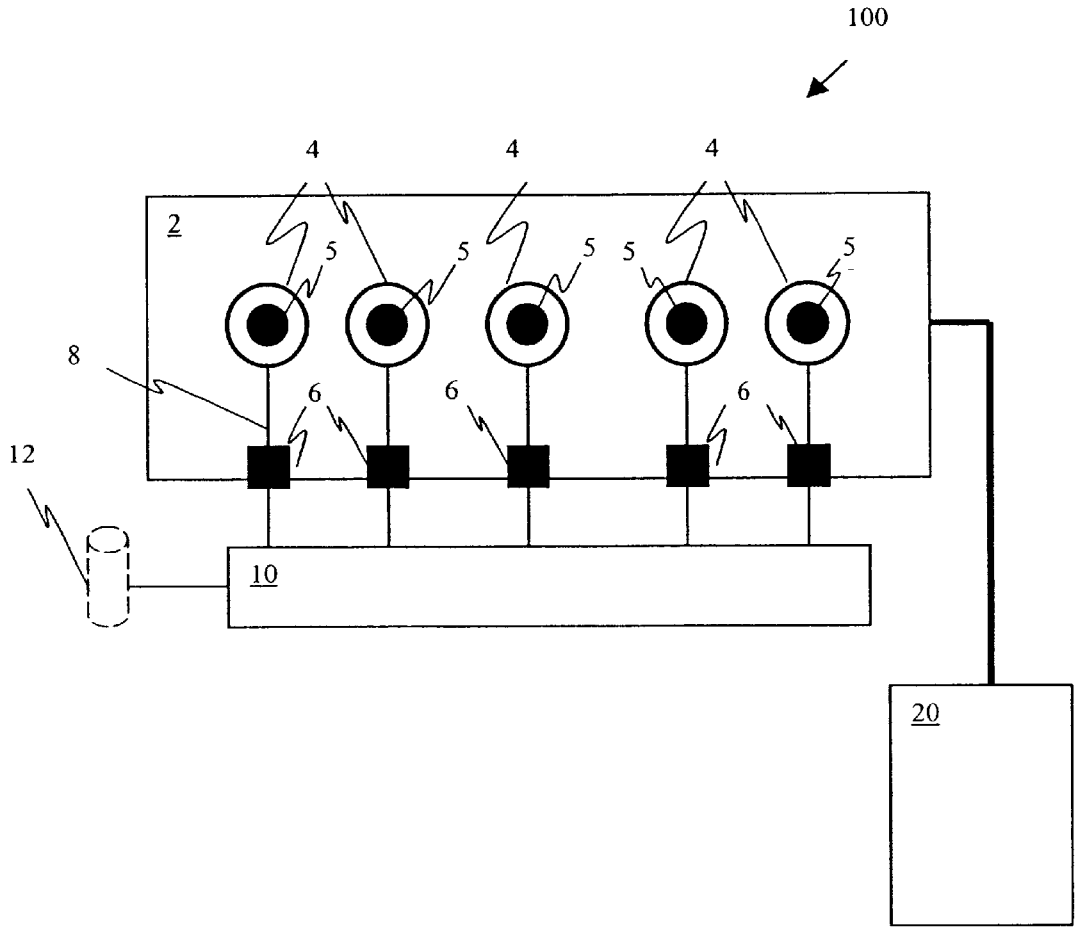
FIG. 1 is a schematic view of a print mechanism in accordance with a preferred embodiment of the present invention.

FIG. 1 illustrates a print head mechanism in accordance with a preferred embodiment of the invention. Mechanism 100 includes printhead 2, at least one ink supply 20, and controller 10. Although mechanism 100 is illustrated schematically and not to scale for the sake of clarity, one of ordinary skill in the art will be able to readily determine the specific size and interconnections of the elements. Printhead 2 can be formed from a semiconductor material, such as silicon, using known semiconductor fabrication techniques, such as complementary metal oxide semiconductor (CMOS) fabrication techniques and micro electro mechanical structure (MEMS) fabrication techniques, or from any materials using any known or future fabrication techniques.

Plural nozzles 5 are formed in printhead 2 to be in fluid communication with ink supply 20 through ink passages (not shown) also formed in printhead 2. Each ink supply 20 may contain a different color ink for color printing. Any number of ink supplies 20 and corresponding nozzles 5 can be used in order to provide color printing using three or more ink colors. Additionally, black and white or single color printing may be accomplished using a single ink supply 20.

Heaters 4 are positioned on printhead 2 around a corresponding nozzle 5. Although each heater 4 may be disposed radially away from an edge of a corresponding nozzle 5, heaters 4 are preferably disposed close to an edge of a corresponding nozzle 5 in a concentric manner. In a preferred embodiment, heater 4 is formed in a substantially circular or ring shape. However, heater 4 may be formed in a partial ring, square, or any appropriate shape. Heater 4 can include an electric resistive heating element electrically connected to pad 6 via conductor 8 or any other type of heating element.

Conductors 8 and pads 6 may be at least partially formed or positioned on printhead 2 and provide an electrical connection between controller 10 and heaters 4. Alternatively, the electrical connection between controller 10 and heaters 4 may be accomplished in any known manner. Controller 10 may be a logic controller, programmable microprocessor, or the like, operable to control heaters 4 and other components of mechanism 100 as described below.

Figure 2:
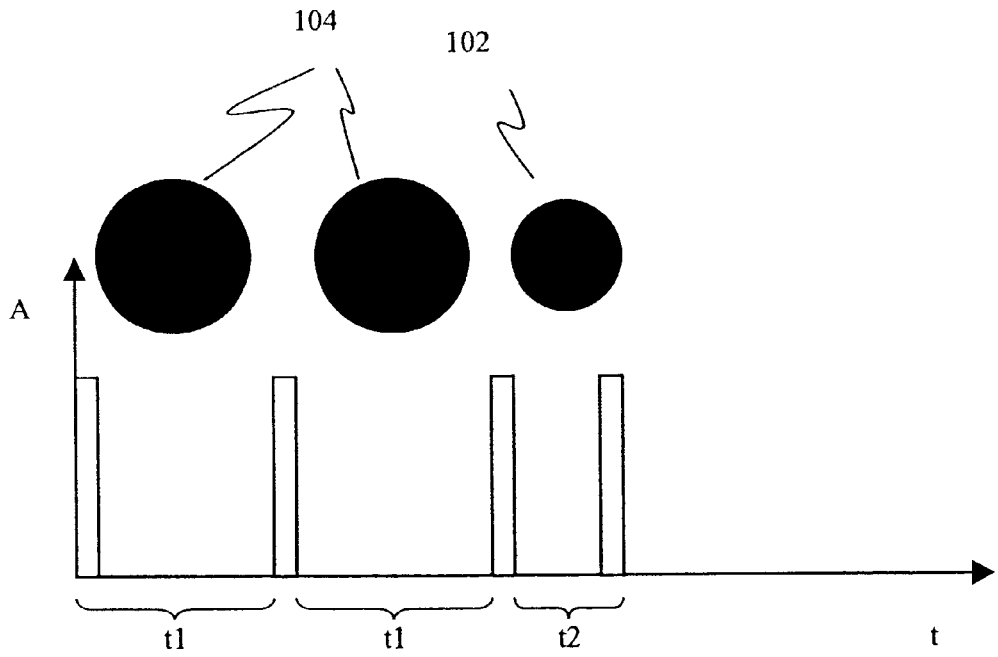
FIG. 2 is a graph of an example of heater activation frequency and the resulting ink droplets.

FIG. 2 illustrates an example of the activation signal frequency provided by controller 10 to one of heaters 4, plotted as signal amplitude versus time, and the resulting individual ink droplets 102 and 104. A high frequency, e.g., a frequency resulting from time t2 between pulses, of activation of heater 4 results in a small volume droplet 102 and a low frequency, e.g., a frequency resulting from time t1 between pulses, of activation of heater 4 results in large volume droplets 104. Activation of heaters 4 may be controlled independently based on the ink color required, movement of printhead 20 relative to a print media P and an image to be printed. A plurality of droplets may be created having a plurality of volumes, including a mid-range activation frequency of heater 4 resulting in a medium volume droplet. As such, reference below to large volume droplets 104 and small volume droplets 102 is for example purposes only and should not be interpreted as being limiting in any manner.

Figure 3:
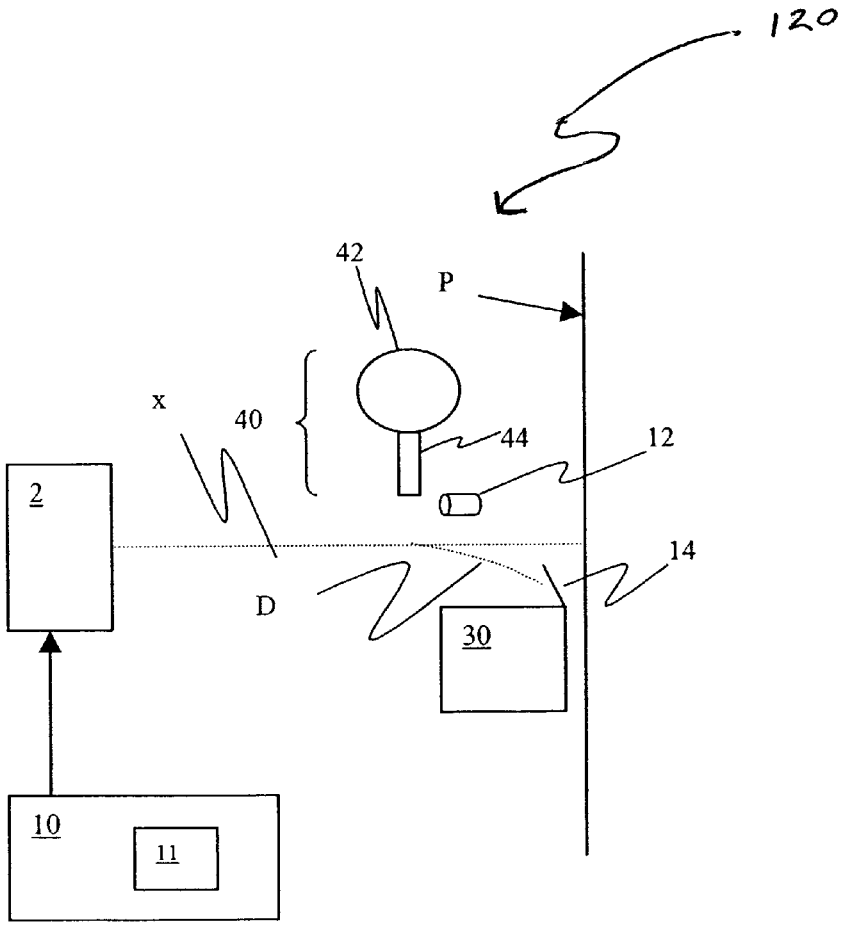
FIG. 3 is a schematic side view of a print apparatus of the preferred embodiment illustrating the ink droplet trajectory.

FIG. 3 illustrates an ink jet print apparatus of the preferred embodiment. Large volume ink droplets 104 and small volume ink droplets 102 are ejected in a stream from printhead 2 along ejection path X. Droplet deflector system 40 applies a force to ink droplets 102 and 104 as the ink droplets travel along path X. The force interacts with ink droplets 102 and 104 along path X, causing the ink droplets 102 and 104 to be deflected. As ink droplets 102 and 104 have different volumes and masses, the force causes small droplets 102 to separate from large droplets 104 with small droplets 102 diverging from path X along deflection angle D. While large droplets 104 are only slightly affected by the force.

Droplet deflector system 40 can include a pressurized gas source 42 that provides the force in the form of a gas flow. Gas source 42 can be a fan for moving ambient air or any other source of pressurized gas. Plenum 44 is coupled to gas source 42 to direct the flow of gas in a desired manner. An output end of plenum 44 is positioned proximate path X. Ink recovery conduit 30 is disposed substantially in opposition to plenum 44 to facilitate recovery of non-printed, i.e., deflected ink droplets for subsequent use. Of course, there can be a separate droplet deflection mechanism and ink recovery conduit for each ink color. However, only one of each of these elements is illustrated for simplicity.

In operation, a print media P is transported in a direction transverse to path X in a known manner. Transport of print media P is coordinated with movement of printhead 2 using controller 10 in a known manner. Pressurized ink is ejected through nozzles 5 creating filaments of ink. Heaters 4 are selectively activated at various frequencies causing the filaments to break up into a streams of individual ink droplets 102 and 104 as described above.

During printing, deflector system 40 is operated. As gas exiting the output of plenum 44 interacts with the stream of ink droplets, the individual ink droplets separate depending on each the volume and mass of each droplet. Accordingly, gas source 42 can be adjusted to permit large volume droplets 104 to strike print media P while small volume droplets 102 are deflected as they travel downward into recovery plenum 30. Accordingly, heaters 4 can be controlled in a coordinated manner to cause ink of various colors to impinge on print media P to form a desired image. Alternatively, deflected droplets can impinge on media P and non-deflected droplets can be recovered.

Large volume droplets 104 and small volume droplets 102 can be of any appropriate relative size. However, the droplet size is primarily determined by ink flow rate through nozzles 5 and the frequency at which heaters 4 are cycled. The flow rate is primarily determined by the geometric properties of nozzles 5 such as nozzle diameter and length, pressure applied to the ink, and the fluidic properties of the ink such as ink viscosity, density, and surface tension. As such, typical ink droplet sizes may range in site from 1 to 10,000 picoliters.

Although a wide range of droplet sizes are possible, at typical ink flow rates, for a 12 micron diameter nozzle, large volume droplets 104 can be formed by cycling heaters 4 at a frequency of about 10 kHz producing droplets of about 60 microns in diameter and small volume droplets 102 can be formed by cycling heaters 4 at a frequency of about 150 kHz producing droplets that are about 25 microns in diameter. These droplets typically travel at an initial velocity of 10 m/s. Even with the above droplet velocity and sizes, a wide range of separation distances between large volume droplets 104 and small volume droplets 102 after deflection is possible, depending on the physical properties of the gas used, the velocity of the gas, and the distance over which the gas interacts with droplets 102 and 104. For example, when using air as the gas, typical air velocities may range from, but are not limited to 100 to 1000 cm per sec while interaction distances may range from, but are not limited to, 0.1 to 10 mm. Gases, including air, nitrogen, etc., having different densities and viscosities can be used for deflection.

It follows that, the separation amount is dependent on the ambient pressure because, assuming constant operation parameters of gas source 42, the velocity of the gas ejected therefrom will vary with the ambient pressure. Accordingly, pressure transients, such as pressure changes caused by activation or termination of a cooling unit in a room containing the printing device, the opening of a door or a window, or any other change in ambient conditions, can cause poor performance of the printing apparatus. For example, a small ambient pressure transient may cause a droplet or portion of a droplet that is intended to go into the recovery conduit 30 to impinge upon the print media P. Accordingly, the preferred embodiment includes a mechanism for compensating for changes in ambient air pressure.

As illustrated in FIGS. 1 and 3, pressure sensor 12 is disposed in print mechanism 120 proximate an output of plenum 44 but in a position in which it does not interfere with the flow of gas from plenum 44. Controller 10 includes logic for receiving a pressure indication signal from sensor 12 and determining a compensation value based on the indication signal. For example, the logic can include a lookup table having corresponding compensation value for each indication signal value or for each range of such values. The indication signal can represent any type of pressure indication, such as, actual pressure, an absolute value of a change in pressure from ambient, or the like.

Controller 10 can include any necessary logic in logic section 11 for determining ambient pressure, such as time based filters, averaging algorithms, or the like. Sensor 12 can comprise plural sensing elements and controller 10 can utilize or and function or the like between the sensing elements to avoid erroneous readings.

Figure 4:
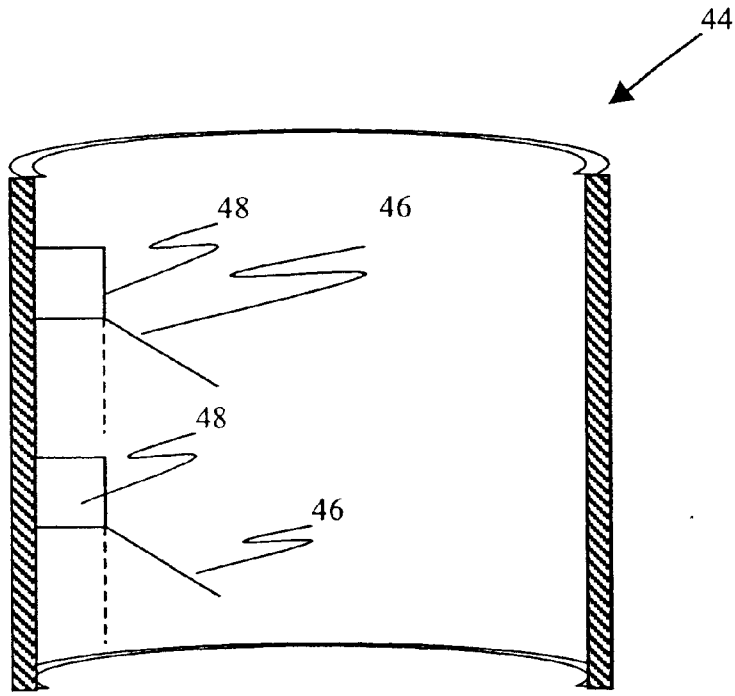
FIG. 4 is a partial sectional view of a gas plenum of the preferred embodiment.

Controller 10 can be coupled to a gas flow adjustment mechanism. For example, as illustrated in FIG. 4, the adjustment mechanism can comprise one or more baffles 46 disposed in plenum 44 to selectively restrict the flow of gas therethrough. Baffles 46 can be activated by actuators 48, such as piezoelectric actuators, MEMs actuators, electromagnetic solenoids, or any other type of actuators. For example, baffles 46 can be moved from a retracted position, represented by the dashed lines, to an extended position, represented by the solid lines. Baffles 46 can be actuated independently or in concert with one another. Baffles 46 may be positioned at any appropriate position. It can be seen that, when baffles 46 are in the extended plenum 44 will be reduced.

Figure 5:
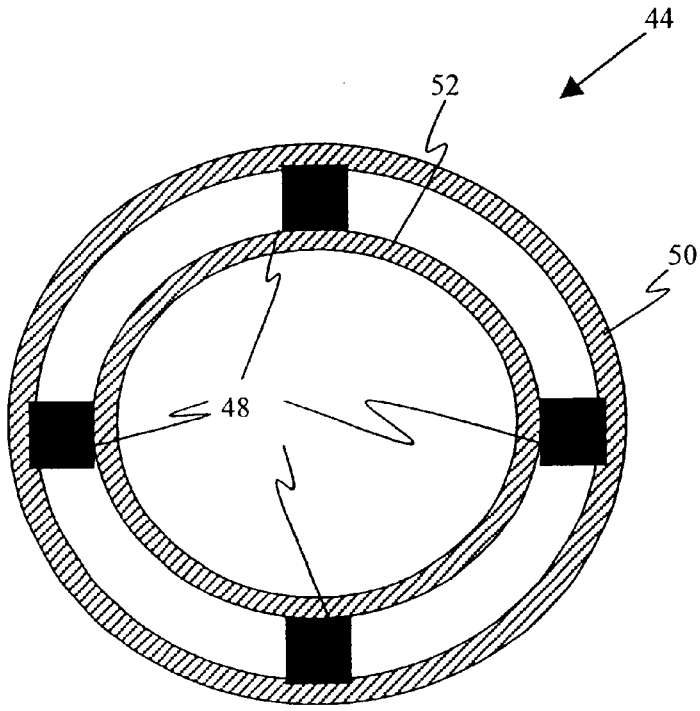
FIG. 5 is a partial sectional view of an alternative gas plenum.

As illustrated in FIG. 5, the pressure compensation mechanism can be a device for selectively altering the size or shape of plenum 44 to restrict gas flow therethrough. For example, actuators 48 can be positioned between a rigid outer portion 50 and a flexible inner portion 52 of plenum 40 to press on inner portion 52 when actuated and thereby adjust the cross-sectional area of plenum 44. When the cross sectional area is reduced, gas flow through plenum 44 is reduced. Once again, actuators 48 can be of any type, such as piezoelectric, MEMS, solenoids, or the like.

Figure 6:
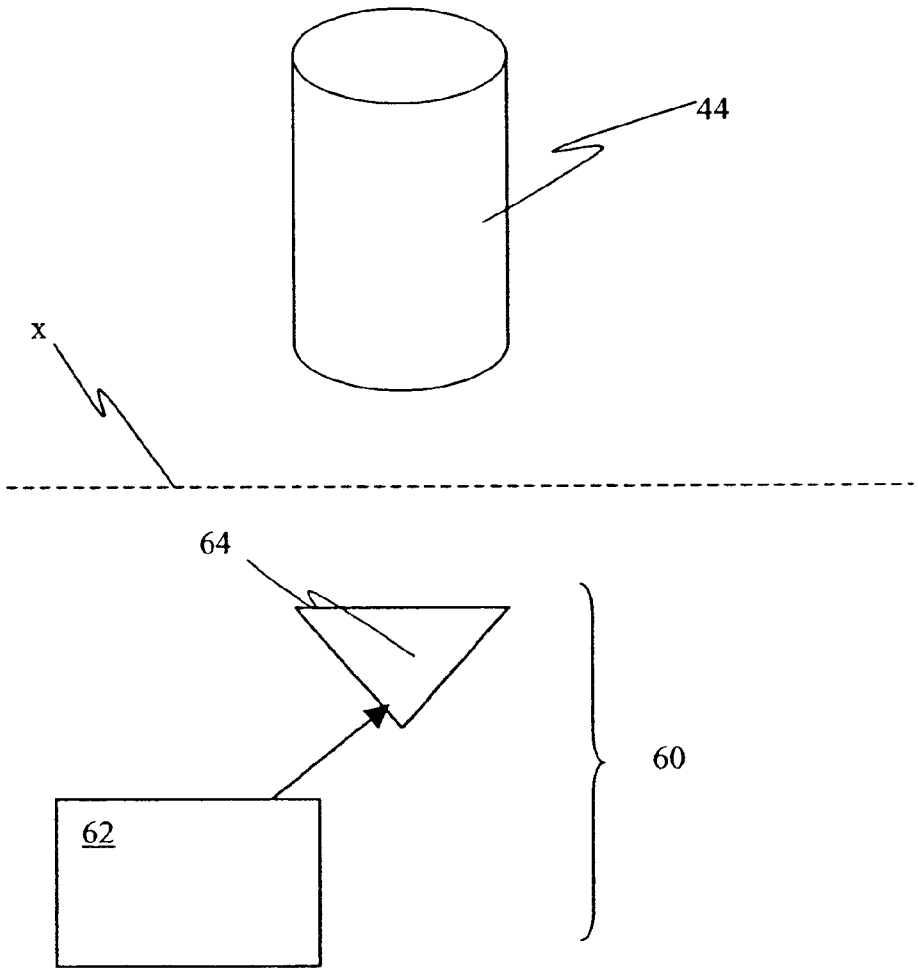
FIG. 6 is a partial sectional view of an alternative pressure compensation mechanism.

FIG. 6 illustrates an alternative pressure compensation mechanism 60 in the form of an acoustic wave generator generating acoustic waves in a manner to interfere with gas flow from plenum 44. Speaker 64 is coupled to wave generator 62 to selectively generate acoustic waves to oppose the gas flow out of the output of plenum 44 and thus selectively restrict the velocity of the gas flow. Wave generator 62 can be controlled by controller 10 in response to the indication signal to control the frequency and/or amplitude of the acoustic waves.

The compensation values can be determined mathematically or through experimentation. Compensation values can be stored as a lookup table, a linear or non linear mathematical formula, or the like.

Printhead 2 can be manufactured using known techniques, such as CMOS and MEMS techniques and can incorporate a heater, a piezoelectric actuator, a thermal actuator, etc. There can be any number of nozzles 5 and the separation between nozzles 5 can be adjusted in accordance with the particular application to avoid smearing and deliver the desired resolution.

Droplet deflector system 40 can be of any configuration and can include any number of appropriate plenums, conduits, blowers, fans, etc. Additionally, droplet deflector system 40 can include a positive pressure source, a negative pressure source, or both, and can include any elements for creating a pressure gradient or gas flow. Recovery plenum 30 can be of any configuration for catching deflected droplets and can be ventilated if necessary. Gas source 42 can be any appropriate source, including a gas pressure vessel or generator, a fan, a turbine, a blower, or electrostatic air moving device.

Any mechanism can be disposed in plenum 48 or at any other position to selectively adjust gas flow based on the sensing of pressure transients. For example, baffles orifices templates or the like can be used. The gas flow adjustment mechanism can be any internal or external mechanism for adjusting the gas flow. The baffles can be of any size, shape, or configuration.

Print media P can be of any type and in any form. For example, the print media can be in the form of a web or a sheet. Additionally, print media P can be composed from a wide variety of materials including paper, vinyl, cloth, other large fibrous materials, etc. Any mechanism can be used for moving the printhead relative to the media, such as a conventional raster scan mechanism, etc.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as by the following claims and their legal equivalents.

Parts List

2 Printhead
4 Heaters
5 Nozzels
6 Pad
8 Conductor
10 Controller
11 Logic Section
20 Ink Supply
30 Recovery Conduit
40 Deflector System
42 Gas Source
44 Plenum
46 Baffles
48 Actuators
50 Plenum Outer Portion
52 Plenum Inner Portion
60 Acoustic Wave Generator
64 Speaker
62 Wave Generator
100 Print Mechanism
102 Small Droplet
104 Large Droplet

What is claimed is:

1. An apparatus for printing an image in which selected droplets in a stream of droplets are deflected to selectively impinge on a print medium, said apparatus comprising:

an ink droplet forming mechanism configured to create a stream of ink droplets having a plurality of volumes and traveling along a trajectory path;

a droplet deflector configured to generate a gas flow at an output thereof interacting with said stream of ink droplets, thereby separating ink droplets having one of said plurality of volumes from ink droplets having another of said plurality of volumes;

a pressure sensor positioned proximate said output and configured to generate an indication signal;

a controller coupled to said pressure sensor and configured to output a compensation signal based on the indication signal; and an adjustment mechanism operatively coupled to said droplet deflector to adjust the gas flow generated by said droplet deflector in response to the compensation signal.

2. The apparatus according to claim 1, wherein said ink droplet forming mechanism includes a nozzle and a heater positioned proximate said nozzle and wherein said controller is operable to selectively actuate said heater to form droplets from a filament of ink being ejected from said nozzle.

3. The apparatus according to claim 2, wherein said controller is operable to selectively actuate said heater at a plurality of frequencies thereby creating said stream of ink droplets having said plurality of volumes.

4. The apparatus according to claim 2, wherein said heater is ring shaped and positioned around said nozzle.

5. The apparatus according to claim 1, further comprising:

a recovery plenum configured to collect said ink droplets having said another of said plurality of volumes.

6. The apparatus according to claim 1, wherein said gas flow is a positive pressure flow.

7. The apparatus according to claim 6, wherein said gas flow is an air flow.

8. The apparatus according to claim 1, wherein said droplet deflector comprises a gas source and a plenum coupled to said gas source to direct said gas flow toward said trajectory path, said adjustment mechanism being coupled to said plenum.

9. The apparatus according to claim 8, wherein said adjustment mechanism comprises a baffle and an actuator configured to move said baffle from a retracted position to an extended position.

10. The apparatus according to claim 8, wherein said adjustment mechanism comprises an actuator coupled to a surface of said plenum to selectively adjust an effective cross-sectional area of said plenum.

11. The apparatus according to claim 1, wherein said adjustment mechanism is an acoustic wave generator opposed to said output of said plenum.

12. A method for printing an image in which selected droplets in a stream of droplets are deflected to selectively impinge on a print medium, said method comprising:

(a) generating a stream of ink droplets having a plurality of volumes and traveling along a trajectory path;

(b) generating a gas flow at an output interacting with said stream of ink droplets, thereby separating ink droplets having one of said plurality of volumes from ink droplets having another of said plurality of volumes;

(c) sensing pressure proximate the output;

(d) generating a pressure indication signal based on the pressure sensed in said step (c); and (e) adjusting the gas flow based on the indication signal.

13. The method according to claim 12, wherein said step (a) comprises ejecting a filament of ink through a nozzle and selectively actuating a heater proximate the nozzle to form droplets from the filament of ink.

14. The method according to claim 13, wherein said actuating step comprises actuating the heater at a plurality of frequencies thereby creating the stream of ink droplets having the plurality of volumes.

15. The method according to claim 13, wherein the heater is ring shaped and positioned around said nozzle.

16. The method according to claim 12, further comprising collecting said ink droplets having said another of said plurality of volumes in a recovery plenum.

17. The method according to claim 12, wherein said step (b) comprises generating a positive pressure gas flow.

18. The method according to claim 12, wherein said step (b) comprises generating an air flow.

19. The method according to claim 12, wherein said step (e) comprises actuating a baffle in a flow path of the gas.

20. The method according to claim 12, wherein said step (e) mechanism comprises adjusting an effective cross-sectional area of a plenum through which the gas flows.

21. The method according to claim 12, wherein said step (e) comprises generating acoustic waves in opposition to the gas flow.

22. An apparatus for printing an image in which selected droplets in a stream of droplets are deflected to selectively impinge on a print medium, said apparatus comprising:

an ink droplet forming mechanism configured to create a stream of ink droplets having a plurality of volumes and traveling along a trajectory path;

a droplet deflector configured to generate a gas flow at an output thereof interacting with said stream of ink droplets, thereby separating ink droplets having one of said plurality of volumes from ink droplets having another of said plurality of volumes;

a pressure sensor positioned proximate said output and configured to generate an indication signal;

a controller coupled to said pressure sensor and configured to output a compensation signal based on the indication signal; and an adjustment mechanism operatively coupled to said droplet deflector to adjust the gas flow generated by said droplet deflector in response to the compensation signal, wherein said droplet deflector comprises a gas source and a plenum coupled to said gas source to direct said gas flow toward said trajectory path, said adjustment mechanism being coupled to said plenum.

23. The apparatus according to claim 22, wherein said adjustment mechanism comprises a baffle and an actuator configured to move said baffle from a retracted position to an extended position.

24. The apparatus according to claim 22, wherein said adjustment mechanism comprises an actuator coupled to a surface of said plenum to selectively adjust an effective cross-sectional area of said plenum.

25. An apparatus for printing an image in which selected droplets in a stream of droplets are deflected to selectively impinge on a print medium, said apparatus comprising:

an ink droplet forming mechanism configured to create a stream of ink droplets having a plurality of volumes and traveling along a trajectory path;

a droplet deflector configured to generate a gas flow at an output thereof interacting with said stream of ink droplets, thereby separating ink droplets having one of said plurality of volumes from ink droplets having another of said plurality of volumes;

a pressure sensor positioned proximate said output and configured to generate an indication signal; p1 a controller coupled to said pressure sensor and configured to output a compensation signal based on the indication signal; and an adjustment mechanism operatively coupled to said droplet deflector to adjust the gas flow generated by said droplet deflector in response to the compensation signal, wherein said adjustment mechanism is an acoustic wave generator opposed to said output of said plenum.

26. A method for printing an image in which selected droplets in a stream of droplets are deflected to selectively impinge on a print medium, said method comprising:

(a) generating a stream of ink droplets having a plurality of volumes and traveling along a trajectory path;

(b) generating a gas flow at an output interacting with said stream of ink droplets, thereby separating ink droplets having one of said plurality of volumes from ink droplets having another of said plurality of volumes;

(c) sensing pressure proximate the output;

(d) generating a pressure indication signal based on the pressure sensed in said step (c); and (e) adjusting the gas flow based on the indication signal, wherein said step (e) comprises actuating a baffle in a flow path of the gas.

27. A method for printing an image in which selected droplets in a stream of droplets are deflected to selectively impinge on a print medium, said method comprising:

(a) generating a stream of ink droplets having a plurality of volumes and traveling along a trajectory path;

(b) generating a gas flow at an output interacting with said stream of ink droplets, thereby separating ink droplets having one of said plurality of volumes from ink droplets having another of said plurality of volumes;

(c) sensing pressure proximate the output;

(d) generating a pressure indication signal based on the pressure sensed in said step (c); and (e) adjusting the gas flow based on the indication signal, wherein said step (e) mechanism comprises adjusting an effective cross-sectional area of a plenum through which the gas flows.

28. A method for printing an image in which selected droplets in a stream of droplets are deflected to selectively impinge on a print medium, said method comprising:

(a) generating a stream of ink droplets having a plurality of volumes and traveling along a trajectory path;

(b) generating a gas flow at an output interacting with said stream of ink droplets, thereby separating ink droplets having one of said plurality of volumes from ink droplets having another of said plurality of volumes;

(c) sensing pressure proximate the output;

(d) generating a pressure indication signal based on the pressure sensed in said step (c); and (e) adjusting the gas flow based on the indication signal, wherein said step (e) comprises generating acoustic waves in opposition to the gas flow.

* * * * *